United States Patent [19]

Sakashita

[11] 4,371,745

[45] Feb. 1, 1983

[54] SHIELDED WIRE

[75] Inventor: Masao Sakashita, Kitamoto, Japan

[73] Assignee: Kabushiki Kaisha Kawai Gakki Seisakusho, Hamamatsu, Japan

[21] Appl. No.: 204,994

[22] Filed: Nov. 7, 1980

[30] Foreign Application Priority Data

Nov. 15, 1979 [JP] Japan ..... 54-157547[U]

[51] Int. Cl.[3] ..... H01B 9/00

[52] U.S. Cl. ..... 174/115; 174/36; 174/102 SC; 174/106 SC; 174/120 R

[58] Field of Search ..... 174/36, 102 SC, 104, 174/115, 106 SC, 113 R, 116, 120 SC

[56] References Cited

U.S. PATENT DOCUMENTS 3,816,644 6/1974 Giffel et al. ..... 174/115

4,002,820 1/1977 Paniri et al. ..... 174/115

*Primary Examiner*—Volodymyr Y. Mayewsky

*Attorney, Agent, or Firm*—Armstrong, Nikaido, Marmelstein & Kubovcik

[57] ABSTRACT

A shielded wire in which an insulation layer covered wire and a ground wire are both covered with a conductive material layer. The ground wire is covered, furthermore, with a conductive high molecular material layer. The latter and the conductive material layer are in mutual contact so that they are mechanically separable from each other and are, at the same time, electrically connected to each other. The conductive high molecular material layer may be made of conductive synthetic resin such as conductive polyvinyl chloride and the like, or of conductive rubber. The conductive material layer may also be made of the latter materials, as well as of metal.

4 Claims, 7 Drawing Figures

SHIELDED WIRE

BACKGROUND OF THE INVENTION

This invention relates to a shielded wire used, for instance, for an electronic musical instrument such as an electronic organ or the like.

In a conventional shielded wire of the preceding species, there has been known, for instance, the type shown in FIGS. 1 and 2, where an electrical insulation layer covered wire a having a core wire $a_1$ and an insulation material layer $a_2$ covering the core wire $a_1$ and a ground wire b are covered with an electrically-conductive material layer c. The layer c is covered with an insulation material outer protecting layer d. A process of connecting one end portion of this shielded wire to a pressure contact type connector is carried out in such a manner that one end portion of the insulation material outer layer d and the electrically-conductive material layer c are peeled off, so that one end portion of the insulation layer covered wire a and the ground wire b are exposed as shown in FIG. 1. Thereafter the ground wire b, before being connected to a contact member of the connector, is covered with a tube for ensuring the connection between the ground wire b and a contact member of the connector. Thus, this shielded wire is inconvenient in that the exposed ground wire b has to be covered with the tube prior to its connection to the contact member as mentioned above, and this procedure is troublesome.

SUMMARY OF THE INVENTION

The present invention has for its object to provide a shielded wire free from this inconvenience, and a shielded wire of the type that an insulation layer covered wire and a ground wire are covered with a conductive material layer. A special feature is that the ground wire is covered with a conductive high molecular material layer and the conductive high molecular material layer and the conductive material layer are in such mutually contact, that they are mechanically separable one from another and are electrically connected one to another.

The novel features which are considered as characteristic for the invention are set as forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
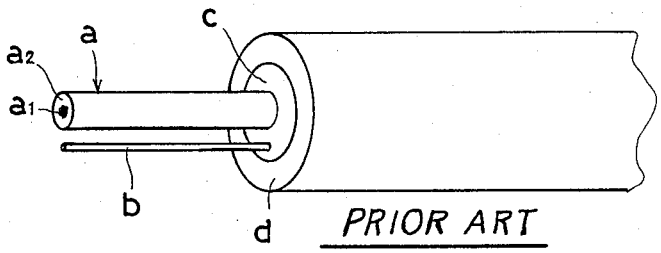
FIG. 1 is a perspective view of a part of a conventional shielded wire.
Figure 2:
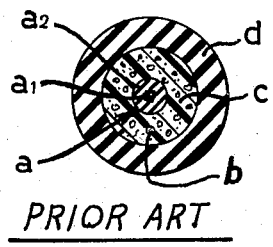
FIG. 2 is a sectional view of FIG. 1.
Figure 4:
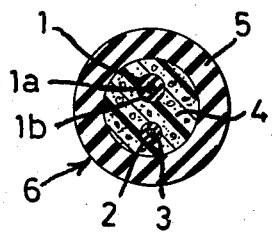
FIG. 4 is a sectional view of FIG. 3.
Figure 3:
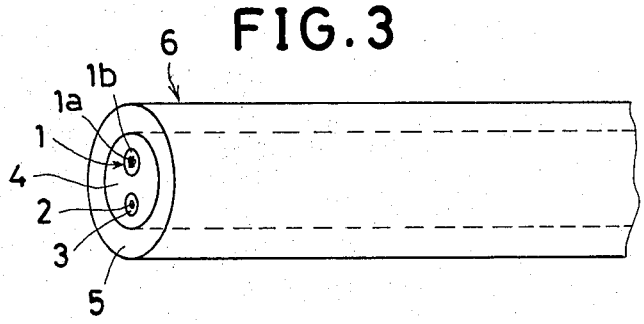
FIG. 3 is a perspective view of one example of the shielded wire, according to the present invention.

Referring to FIGS. 3 and 4 showing one example thereof, numeral 1 denotes an insulation layer covered wire comprising a core wire 1*a* made of a number of fine wires and an electrical insulation material layer 1*b* made of synthetic resin such as polyvinyl chloride or the like or of rubber covering the wire 1*a*. Reference numeral 2 denotes a ground wire covered with an electrically-conductive high molecular material layer 3 formed by extrusion molding. The insulation layer covered wire 1 and the ground wire 2 covered with the layer 3 are further covered with an electrically-conductive material layer 4 formed by extrusion molding. Additionally the layer 4 is covered with an electrical insulation material outer protecting layer 5 formed by extrusion molding. The conductive high molecular material layer 3 is made of electrically-conductive polyvinyl chloride prepared by mixing polyvinyl chloride and metallic powder, for instance, and the conductive material layer 4 is also made of conductive polyvinyl chloride, for instance, and the two layers 3, 4 are in such a mutually contact relationship that the two are mechanically separable one from another and are electrically connected one to another. Thus, there is formed a shielded wire 6 according to the present invention.

Figure 7:
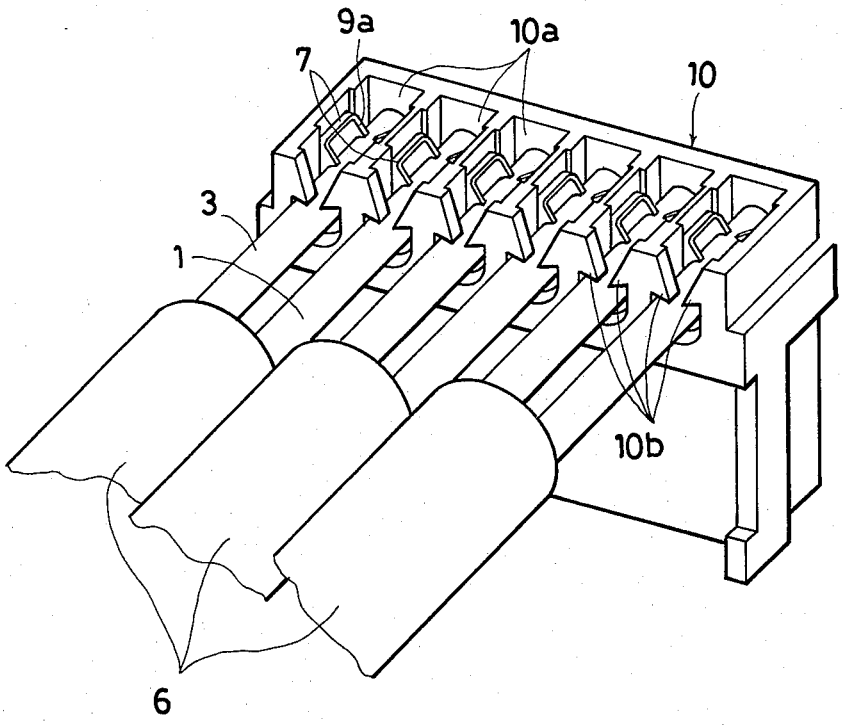
FIG. 7 is a perspective view of the connector having a number of wires connected thereto, according to the present invention.

Next, a process of connecting this shielded wire 6 to a pressure contact type connector 10 will be explained with reference to FIGS. 6 and 7 as follows:

As shown in FIG. 7, the connector 10 is composed of a housing in which a large number of contact members 7 are previously set in respective recess openings 10*a*.

As shown in FIG. 6, each of the contact members 7 is provided with a slit 9 having on its both sides side edges 8, 8 and at its top end, a V-shaped opening 9*a*.

Figure 5:
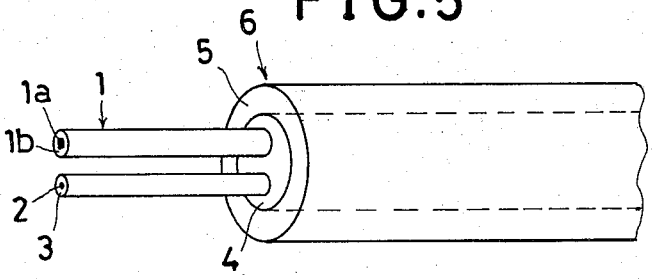
FIG. 5 is a perspective view of FIGS. 3–4, when ready to be connected to a pressure contact type connector.

First, one end portion of the insulation material outer layer 5 and the conductive material layer 4 are peeled off to their desired length as shown in FIG. 5, so that one end portion of the insulation layer covered wire 1 and the ground wire 2 covered with the conductive high molecular material layer 3 are exposed outside.

Figure 6A:
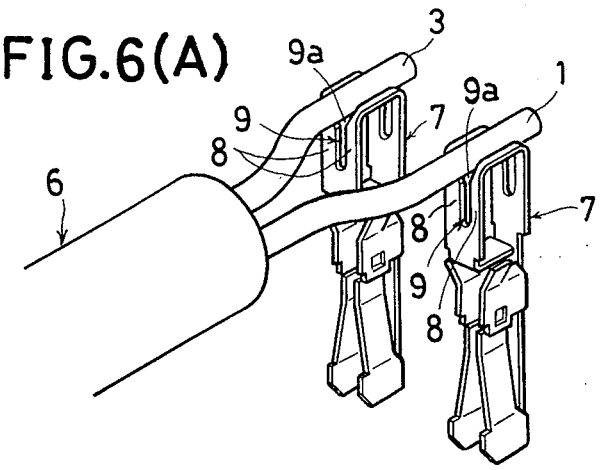
FIGS. 6A, 6B and 6C are perspective views showing the manner of connection with the connector.
Figure 6B:
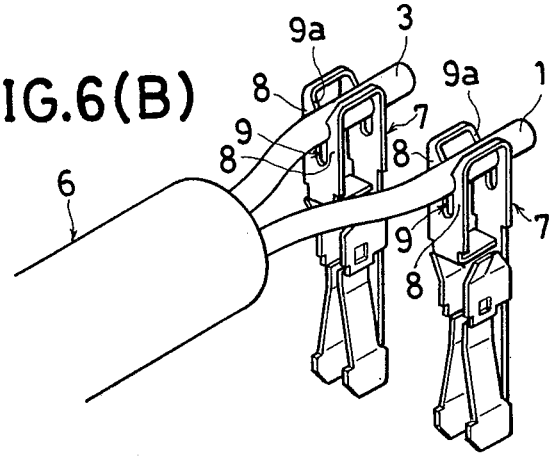
Figure 6C:
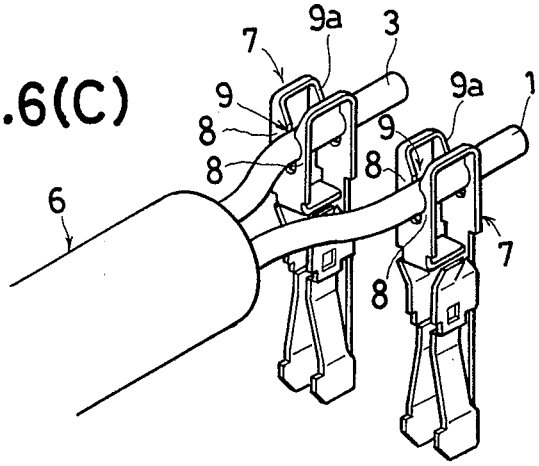

Next, as shown in FIG. 6A, the exposed insulation layer covered wire 1 and the exposed ground wire 2 covered with the layer 3 are put in the V-shaped openings 9*a*, 9*a* of the slits 9, 9 in the respective contact members 7, 7. Then, as shown in FIG. 6B, the ground wire 2 is pushed downwards into a lower portion of the slit 9, so that the layer 3 of the ground wire 2 is cut by the side edges 8, 8 and is then further pushed downwards as shown in FIG. 6C.

Thus, the ground wire 2 is brought into pressure contact with the side edges 8, 8, whereby it is electrically connected to the contact member 7 and the electric connection is firmly assured due to the cut-in engagement between the covering layer 3 and the side edges 8, 8.

The same connecting procedure is applied to the insulation covered wire 1. Thus, a number of shielded wires according to the present invention, can be connected to the connector 10 as shown in FIG. 7.

Each recess opening 10*a* is provided on one side thereof with a pair of projections 10*b* as shown in FIG. 7, and these projections 10*b* are brought into engagement with the covering layer 1*a* or 3 and prevent the wire 1 or 2 from coming out upwards. The conductive high molecular material layer 3 is not limited to that made of the foregoing conductive polyvinyl chloride, but may be made of any of other conductive synthetic resins or conductive rubber. The conductive material layer 4 is not limited to that made of the foregoing conductive polyvinyl chloride but may be made of any of other conductive synthetic resins or conductive rubber or metal.

The shielded wire according to the present invention, is suitably used for being connected to the pressure contact type connector as above but is not limited thereto.

Thus, according to the present invention, in a shielded wire of the type where the insulation material layer covered wire and the ground wire are covered with the conductive material layer, the ground wire is covered with the conductive high molecular material layer. This latter layer and the foregoing conductive material layer are kept in such mutual contact that the two are mechanically separable one from another and are electrically connected one to another. Therefore, in the case of connecting thereof with a connector, such a procedure that the ground wire is covered with a tube as required in the conventional shielded wire can be eliminated, and consequently the connecting operation thereof can be facilitated.

Without further analysis, the foregoing does so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A shielded wire suitable for use with a pressure clip connector, said wire consisting of a first wire having an electrical insulation layer thereon, a ground wire, an electrically-conductive high molecular material layer covering said ground wire, an electrically-conductive material layer covering both said first wire with electrical insulation layer and said ground wire with electrically-conductive high molecular material layer; and an outer electrically-insulating layer covering said electrically-conductive material layer; said electrically-conductive high molecular layer and said electrically-conductive material layer being in mutual contact so that they are mechanically separable from each other and are electrically connected to each other; said electrical-insulation layer and said electrically conductive high molecular material layer being substantially equal in thickness and diameter to each other.

2. A shielded wire as defined in claim 1, wherein said electrically-conductive high molecular material layer is comprised of an electrically-conductive synthetic resin selected from the group consisting of electrically-conductive polyvinyl chloride and electrically-conductive rubber.

3. A shielded wire as defined in claim 1, wherein said electrically-conductive material layer is comprised of a material selected from the group consisting of electrically-conductive polyvinyl chloride and electrically-conductive rubber.

4. A shielded wire as defined in claim 2, wherein said electrically-conductive material layer is comprised of a material selected from the group consisting of electrically-conductive polyvinyl chloride and electrically-conductive rubber.

* * * * *